United States Patent [19]

Hanrahan, Jr. et al.

[11] 4,086,790

[45] May 2, 1978

[54] THERAPEUTIC GARMENT AND METHOD

[75] Inventors: James R. Hanrahan, Jr., Fairfield, Conn.; Richard G. Levine, Lawrence, N.Y.

[73] Assignee: A.I.R. Industries, Inc., Fairfield, Conn.

[21] Appl. No.: 618,180

[22] Filed: Sep. 30, 1975

[51] Int. Cl.[2] ..... D04B 11/00

[52] U.S. Cl. ..... 66/178 A; 66/185; 66/186

[58] Field of Search ..... 66/172 E, 177, 178 A

[56] References Cited

U.S. PATENT DOCUMENTS

| | | | |
|---|---|---|---|
| 2,229,790 | 1/1941 | Beuter et al. | 66/186 X |
| 2,826,760 | 3/1958 | Rice | 66/177 UX |
| 3,069,883 | 12/1962 | Burleson et al. | 66/178 A |
| 3,187,522 | 6/1965 | Knohl | 66/186 |
| 3,241,340 | 3/1966 | Knohl | 66/185 |
| 3,250,092 | 5/1966 | York et al. | 66/178 A |
| 3,301,018 | 1/1967 | Knohl | 66/178 A |
| 3,386,270 | 6/1968 | Simmons | 66/178 A |
| 3,425,246 | 2/1969 | Knohl | 66/187 X |
| 3,443,404 | 5/1969 | Knohl | 66/186 |
| 3,453,843 | 7/1969 | Knohl et al. | 66/187 X |
| 3,564,873 | 2/1971 | Beane | 66/177 |
| 3,566,624 | 3/1971 | Burleson | 66/177 |
| 3,595,034 | 7/1971 | Safrit | 66/177 |
| 3,729,956 | 5/1973 | Nebel | 66/172 E |
| 3,808,842 | 5/1974 | Fisher et al. | 66/177 |
| 3,889,494 | 6/1975 | Patience et al. | 66/178 A |

FOREIGN PATENT DOCUMENTS

| | | | |
|---|---|---|---|
| 68,944 | 9/1969 | Germany | 66/177 |
| 634,830 | 12/1947 | United Kingdom | 66/172 E |

*Primary Examiner*—Ronald Feldbaum

[57] ABSTRACT

A circular knit therapeutic garment in which bare elastomeric yarn is knit in selected courses and wales with a non-elastomeric yarn in other selected courses and wales in the boot portion of a stocking to provide a retractive or compressive force of graduating degrees as required with a circumferential heel-instep band of lesser retractive or compressive force, and a closed toe area in which stretchable fabric with minimal retractive forces is integrally knit to the foot portion of the garment whereby the bar elastomeric yarns are buried or concealed by the knitted non-elastomeric yarns to provide improved hand and snag resistance and retractive force on the leg of a wearer.

13 Claims, 5 Drawing Figures

THERAPEUTIC GARMENT AND METHOD

BACKGROUND, OBJECTIVES AND ADVANTAGES OF THE INVENTION

Men and particularly women suffer from edema and complications of phlebitis and stasis ulcers as well as other venous inflammatory diseases particularly during protracted bed confinement whether from accidents or fractures or extended illnesses. Post surgical convalescence for certain patients prescribe wearing of some form of elastic bandage, elastic surgical support stockings or other means for preventing conditions of phlebitis or other venous inflammatory conditions and possible complications that may develop in disabled patients. Prenatal and postnatal care in women who have experienced a tendency of swelling and pain in the legs generated by edema have found a measure of relief by some types of support or surgical stockings. Others who have experienced "tired legs" have found a measure of relief by wearing hoisery that has some retractive or compressive force.

Many of the objections encountered by women particularly in wearing surgical support stockings or elastic bandages had been generated by the objectionable appearance of the rather course surgical stockings on the leg of the wearer.

In more recent years, with the advent of torque thermoplastic yarns, stretchable nylon stockings have afforded a measure of retractive or compressive force on the leg of the wearer depending upon the volume of the leg and the size of the stocking. With the advent of elastomeric yarns in the spandex family, some support-type stockings have been produced in which stretchable nylon yarns have been knitted with covered spandex yarn laid-in in selected courses of the stocking. In some other types of support stockings, covered spandex has been employed in selected courses by knitting-in to provide the desired retractive force. Some stockings have been produced in which bare spandex has been used by laying-in without providing the high compressive forces desired or the graduated retractive force throughout the leg of the wearer in the vital region below the knee.

Generally, most support stockings available commercially are also objectionable by reason of the lack of control of the tension in the yarns to provide graduated degrees of retractive force in the foot, ankle, and calf of the wearer's leg. Furthermore, no provision has been made to relieve the compressive force about the toe area in order to provide increased comfort.

In those support stockings that have employed bare spandex or elastomeric yarns, such yarns have been exposed to the leg of the wearer and provide an objectionable clammy and rubber feel or hand. Spandex tends to snag readily when exposed, and minimal abrasion has caused exposed spandex yarns to sever and deterioration of the entire stocking occurs upon fracture of one or more of the spandex yarns.

The use of surgical support stockings or elastic bandages has been objectionable also due to the overlapping or wrinkling of the fabric in the instep portion which may tend to pinch the wearer'foot.

It is an objective of this invention to provide a therapeutic garment in the form of a circular knit stocking in which spandex or elastomeric yarns are knit in conjunction with non-elastomeric yarns to provide a retractive or compressive force on the leg of a wearer to provide relief from phlebitis and other venous inflammatory diseases and complications.

Another objective of this invention is to provide a therapeutic garment made on a circular knitting machine using elastomeric and non-elastomeric yarns for a relatively sheer stocking to be worn by patients and others having venous inflammatory diseases and those who require a retractive force whether confined to bed or wheel chair for prolonged periods or for periods of convalescence or for alleviating leg pain and swelling.

Still another objective of this invention is to provide a therapeutic garment in which elastomeric and non-elastomeric yarns are knit on a circular knitting machine under suitable tensions to provide graduated a compressive force in a boot of a stocking when on the leg of a wearer and in which there is freedom of toe movement with minimum fabric overlapping or wrinkling in the heel-instep area.

Yet another feature of this invention is the provision of a combination panty and stocking garment in which selected sections knit on a circular knitting machine have been provided with knitted elastomeric and non-elastomeric areas to provide increased retractive force on the leg of a wearer.

Other objectives of this invention and many of the attendant advantages will become more readily apparent to those skilled in the knitting art from the following detailed description of the accompanying drawing and detailed description of the knitted fabric and method of producing a stocking of knee-high length, a conventional stocking length or a combination panty and stocking garment.

DESCRIPTION OF THE DRAWING FIGURES

Figure 3:
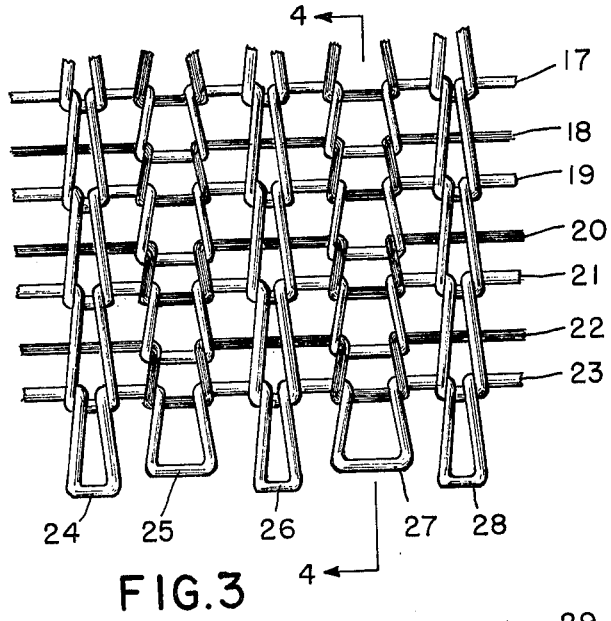
FIG. 3 is an enlarged diagrammatic view of the knitted structure of a portion of the circular knitted fabric in the therapeutic boot portion of the garment of FIGS. 1 and 2.
Figure 5:
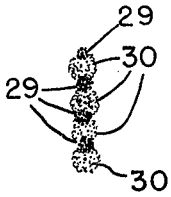
Figure 4:
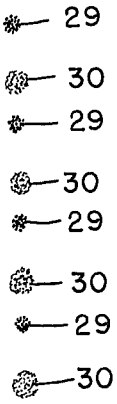

FIG. 4 is a transverse sectional view taken along the line 4—4 of FIG. 3 illustrating only the orientation of the yarns in relationship to each other with the fabric in the extended or stretched condition; and FIG. 5 is a transverse sectional view similar to FIG. 4 but illustrating the fabric of the boot portion relaxed substantially and presenting the larger non-elastomeric yarns which substantially conceal from view the bare elastomeric yarns.

DETAILED DESCRIPTION OF PREFERRED EMBODIMENTS OF THE INVENTION AND METHOD

Figure 2:
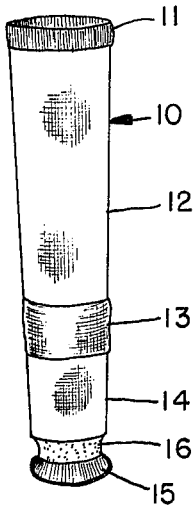
FIG. 2 is a front elevational view of a knee-high stocking incorporating the knitted structure of the therapeutic boot portion which extends into the foot portion of the stocking.

Referring to FIGS. 2 and 3 of the drawing, there is illustrated in FIG. 2 a knee-high stocking 10 that is provided with a turned welt portion 11, a boot portion 12, an intermediate heel-instep portion 13 combined with a section of the foot portion 14 at the end of which is a closed toe section 15 with an intermediate stretchable fabric section 16, all of which sections and portions are integrally knit on a circular multi-feed knitting machine. The tapered knee-high stocking 10 shown in FIG. 2 is knit as a cylindrical tube without any reciprocation to form a heel pocket or toe pocket. The stocking 10 shown in FIG. 2 is provided with a taper by virtue of graduated stitch length control on the circular knitting machine and the finished stocking is preferably unboarded.

It has been determined that improved elasticity and retractive force of a knitted fabric utilizing spandex yarns is more desirable as opposed to heat-setting the knitted fabric and stitches when all thermoplastic yarns of spandex, nylon and polyester are employed. Furthermore, there is less tendency for any coalescing of the spandex and other thermoplastic yarns which may occur at elevated temperatures during boarding. Of course, when cotton yarns are knit in combination with the spandex yarns, only the spandex yarns would be set at the appropriate temperature while the cotton yarns in the knitted fabric would simply be pressed and would not remain pressed or set after the first washing while the thermoplastic spandex yarn stitch configuration would be set depending upon the setting temperature for the particular spandex yarn.

It has been found desirable for one specific knee-high stocking to employ multifilament nylon yarn to which has been imparted stretch characteristics by any of the known processes of imparting stretch characteristics as by false twisting in order to achieve the desired stretch characteristics. While the denier of the nylon yarn may vary, it has been found desirable to employ 70 denier single multifilament nylon yarn. For heavier constructions, two-ply 70 singles totalling 140 denier may be utilized. Other types of textured yarns may be employed depending upon the desired hand and covering factor in order to protect and conceal the bar elastomeric or spandex yarns.

The preferred spandex or elastomeric yarns employed to achieve the desired power or modulus for the desired retractive or compressive force is duPont's type 128 "LYCRA" 180 denier knit with the non-elastomeric yarns as will be described hereafter. It has been found desirable to achieve the desired retractive or compressive force to apply a tension of approximately 6 to 7 grams to the spandex yarns before reaching the yarn feed finger and knitting elements on the knitting machine where the tension will be increased but cannot be measured accurately. The tension applied to the 70 denier stretchable nylon yarn is approximately 3 grams before the yarn feed finger and knitting elements and these elements will also increase the tension on the nylon yarn before knitting it into the fabric.

Conventional Lonati 8-feed machines have been converted to 4-feed machines to produce the circular knit fabric in which alternate feeds supply non-elastomeric yarns, such as nylon, and intermediate feeds supply the spandex yarns to the knitting elements. Through proper needle selection and graduated stitch control, throughout at least the portions of the stocking 10 in which the proper retractive or compressive force is to be obtained, the alternate non-elastomeric yarn feeds supply the nylon yarns to all of the 400 needles while the intermediate elastomeric yarn feeds supply the spandex yarns to every other needle in intermediate courses while floating the spandex yarn over alternate wales.

As shown in FIG. 3, courses 17, 19, 21, and 23 represent the alternate courses in the boot and portion of the foot of the stocking 10 which will provide the appropriate compressive force to the leg of a wearer in which non-elastomeric yarns are knit. The intermediate courses, 18, 20, and 22 include only the spandex yarns which are knit in intermediate wales 25 and 27 and floated past the alternate wales 24, 26 and 28.

In FIG. 4, there is illustrated schematically the positioning of the elastomeric yarns 29 in relation to the non-elastomeric yarns 30 in the fabric extended condition, somewhat exaggerated in FIGS. 3 and 4. The stitch density is such that the spandex yarns 29 cannot be seen readily by the naked eye nor can they be felt either on the leg of the wearer or by hand. The relative sizes of the yarns used and the cover provided by the non-elastomeric yarns conceal or bury the elastomeric yarns and prevent them from being abraded and snagged. There is little if any difference in placing or removing a stocking of this construction on or off the leg of a wearer despite the significant amount of spandex yarn used to obtain the power and modulus to achieve the support characteristics and therapeutic value desired recognizing that bare spandex yarn has a tendency to cling and resist slippage in the bare condition.

A medium size knee-high stocking including welt and closed toe is approximately 19 inches long in the relaxed and unboarded condition. The relaxed width of the stocking adjacent to the section 16 is $3\frac{1}{8}$ inches wide in flattened condition, and the width of the relaxed flattened stocking in the boot portion immediately adjacent to the welt 11 is $4\frac{1}{8}$ inches. The flattened and unboarded stocking knit of 70 denier stretch nylon yarn and 180 denier "LYCRA" yarn is $3\frac{1}{2}$ inches in width at a position one-half the length of the knee-high stocking which is 19 inches in length.

In order to provide increased comfort without binding and eliminate heel reciprocation in order to achieve optimum compressive control in the heel-instep area portion 13, a circumferential band that is approximately 2 inches in length is integrally knit to provide increased stitches relative to adjacent portions of the fabric whereby the relaxed portion 13 measures $3\frac{1}{2}$ inches in the medial portion, approximately $\frac{1}{4}$-inch greater than the adjacent fabric sections. This heel-instep portion 13 will readily accomodate the heel of the wearer and the instep without undue stress and binding.

The section 16 in the toe portion of the foot 14 is knit using 20 denier stretchable nylon yarns on all needles without any spandex yarn in order to provide a non-binding toe portion in the fabric which is integrally knit to the foot portion 14 and to the toe end portion 15 which is perferably knit of stretchable 70 denier nylon yarn for improved wear resistance. The toe end is closed by conventional overedge seaming.

The knee-high stocking 10 is illustrated in FIG. 2 does not require any gartering since the turned welt 11 may be provided with conventional knit-in or laid-in spandex yarns in selected courses in combination with the non-elastomeric yarns. For bed and wheel chair patients, the knee-high stockings may be worn day and night or at prescribed intervals. For those who require surgical or therapeutical stockings while on their feet during walking or standing for prolonged periods, the knee-high stocking may be worn as prescribed. Should there be any objection to the appearance cosmetically, particularly when the non-elastomeric yarn may be cotton, which may be required for certain skin conditions and moisture absorption, a sheer nylon stocking may be worn over the surgical or therapeutic stocking and appropriately gartered.

The density of knitted stitches made from elastomeric and non-elastomeric yarns will vary somewhat from stocking to stocking. However, in order to accomodate the different sizes of leg lengths and volumes, it has been determined to be desirable to have four separate sizes in each category of lengths for short, regular, and long in which there will be small, medium, large, and extra large sizes in each length category. The length of the toe portion 15 will be standard and range within approximately three-fourth of an inch. The band 16 will be approximately 1 inch in length. The section 14 will vary from 3 to 4¼ inches in each of the four sizes in each length category. The heel-instep section 13 length will vary from 2 to 2¼ inches for the four sizes in each length category. The length of the boot 12 will vary from 8½ to 11 inches in the size range for the short length, from 9½ to 12 inches for the four sizes in the regular length, and from 10¾ to 13¼ inches for the four sizes in the long length. The welt portion will be approximately 1½ inches in length.

Figure 1:
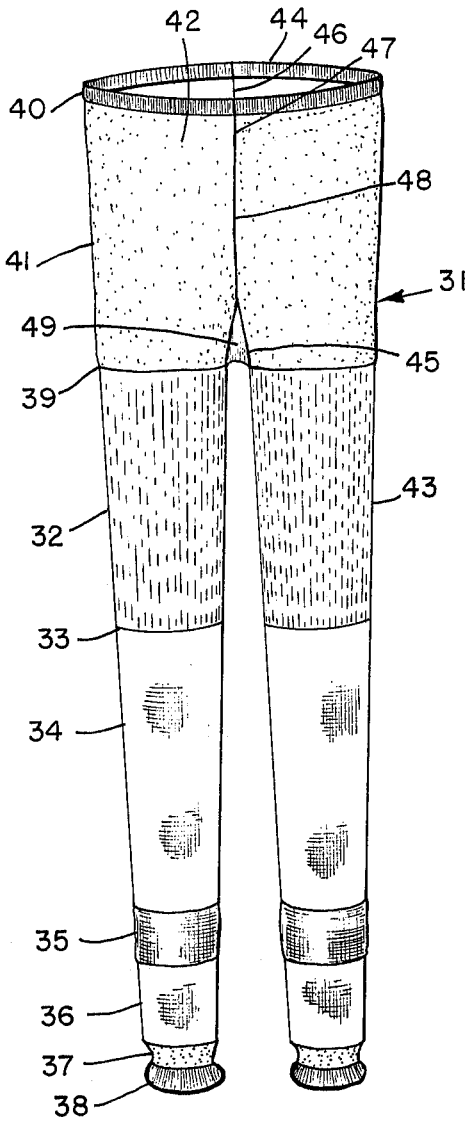
FIG. 1 is a front elevational view of a combination panty and stocking garment incorporating the knitted structure for the therapeutic boot portion of each leg.

The therapeutic and support characteristics of the knee-high stocking described in FIGS. 2 and 3 may also be incorporated in the various sizes for a combination panty and stocking garment 31 as illustrated in FIG. 1. Individual abnormally elongated stockings are knit on a circular knitting machine with the abnormally elongated welt 32 that extends above the knee delineated by the upper portion of the boot at line 33 where the spandex and non-elastomeric yarns are knit as previously described in the manner shown in FIG. 3 in the boot 34 with the graduated stitched of the same nature and character as previously described for the knee-high stocking 10. Similarly, the heel-instep portion 35 is similar to the heel-section 13 of FIG. 2 with its graduated stitches forming enlarged portions in the tapered stocking to limit any constriction in the heel, ankle and instep portions on the foot and leg of the wearer. The foot portion 36 is constructed in a manner similar to the foot portion 14 with the section 37 corresponding to section 16, and the toe portion 38 of FIG. 1 corresponding to the section 15 in FIG. 2 in which the toe closure is formed. The portion 32 may be knit of conventional jersey circular knit fabric without any spandex yarn, preferably stretchable nylon yarn. The abnormally elongated welt may have a yarn change at 39 to the waist band 40 to form a section 41 of the panty 42 of the combination panty and stocking garment 31. The waist band 40 may be integrally knit by forming a turned welt with knit-in or laid-in spandex yarn or an elastic band may be sewn to the upper edge of the panty portion to encircle the waist of the wearer when a second abnormally elongated stocking blank 43 corresponding to the first abnormally elongated stocking blank is suitable slit from the upper edge 44 of the waist band 40 downwardly toward the crotch 45 forming vertical edges 46 and 47 in each of the blanks. Adjacent edges are overedge seamed together to form a U-shaped seam 48, and a crotch piece 49 may be inserted for reinforcement, if necessary.

The combination panty and stocking garment better known as "Pantyhose" eliminates supplemental gartering which may be objectionable in many patients and others who have phlebitis and other venous inflammatory diseases. It will be readily apparent that the vertical extent of the retractive action using spandex yarns may vary depending upon the specific requirements of particular individuals. Furthermore, increased support may be provided in the panty portion other than using stretchable textured thermoplastic yarns. Many modifications may be made to the length of the various loosely knit portions and the portions of the stocking omitting elastomeric yarn to relieve certain conditions but it has been found desirable to avoid exposing the bare spandex yarn to avoid abrasion and snags and to maintain the desired feel of the non-elastomeric yarns.

We claim:

1. A circular knit unboarded tubular tapered non-reciprocated therapeutic garment having foot and boot portions, said boot portion having alternate wales with stitches of non-elastomeric yarns connect with intermediate stitches of elastomeric yarn in each said intermediate wale, said elastomeric yarn stitches being substantially dominated, covered and protected by said non-elastomeric yarn stitches in the relaxed and stretched conditions of the garment and whereby said elastomeric yarn stitches are protected from direct contact with the leg of the wearer, said tapered garment having graduated stitches extending throughout the boot and foot portions in increments varying directly with the girth of the leg of the wearer to provide graduated compressive force on the leg of the wearer, said foot portion having an intermediate heel-instep circumferential band of the same knitted structure as said boot portion with less retractive force generated by said stitches within the intermediate heel-instep circumferential band than the stitches immediately preceding and following said band producing a slightly enlarged bulging area extending outwardly from the tapered contour of said garment in the relaxed fabric condition relative to said boot portion, said stitches throughout said intermediate heel-instep circumferential band are all of uniform increased length of equal size relative to the stitches in the boot portions adjacent thereto, said foot portion having a closed toe portion with the major section of said toe portion having the same knitted construction as said boot portion with stitches of the non-elastomeric and elastomeric yarns being more dense and shorter than any of the stitches in any portion of the boot, said toe portion further provided with a toe section having a series of courses of stretchable non-elastomeric yarns forming a band of relatively sheer stretchable fabric whereby reduced stress is placed on the toes of the wearer.

2. A circular knot therapeutic garment as claimed in claim 1, said garment having a welt portion integrally knit to said boot portion and having elastomeric and non-elastomeric yarns knitted in selected courses and wales.

3. A circular knit therapeutic garment as claimed in claim 1, said intermediate elastomeric stitches and alternate non-elastomeric stitches form alternate courses, said intermediate elastomeric stitches being connected continuously by a floated stitch of the same elastomeric yarn extending across alternate non-elastomeric stitches.

4. A circular knit therapeutic garment as claimed in claim 1, said non-elastomeric yarn being multifilament nylon yarn.

5. A circular knit therapeutic garment as claimed in claim 1, said non-elastomeric yarn being monofilament nylon yarn.

6. A circular knit therapeutic garment as claimed in claim 1, said non-elastomeric yarn being multifilament textured yarn.

7. A circular knit therapeutic garment as claimed in claim 1, said non-elastomeric yarn being cotton yarn.

8. A circular knot therapeutic garment as claimed in claim 1, said boot portion being at least of knee-high length.

9. A circular knit therapeutic garment as claimed in claim 1, said garment having an abnormally elongated welt portion above said boot portion in which all courses and wales contain non-elastomeric yarns, said elongated welt portion extending to the waist of a wearer, a corresponding garment with an abnormally elongated welt portion connected to said other abnormally elongated welt portion of said other garment in the elongated welt portions of each by a substantially U-shaped seam to form a panty portion, and an elastic waistband encircling said welt portions to support said combination garments about the waist of a wearer with depending stockings extending from said panty portion.

10. A circular knit therapeutic garment as claimed in claim 1, said elastomeric yarn being uncovered.

11. The method of knitting a tubular, non-reciprocated therapeutic and support garment from elastomeric and non-elastomeric yarns on a multifeed circular knitting machine having a cylinder, yarn feeding and knitting elements comprising the steps of feeding the non-elastomeric yarn to all the knitting elements to form stitches in all wales and in alternating courses, feeding the elastomeric yarn to every other knitting element and floating across other knitting elements in intervening courses, graduating the length of all stitches to form a tapered tubular blank while applying a yarn tension during knitting of approximately 7 grams on the elastomeric yarn before the yarn feeding and knitting elements to form the boot and foot portions of said garment, and forming an enlarged outwardly extending and circumferential heel-instep band approximately 2 inches in length by increasing the length of all stitches uniformly to be the same increased length in said band.

12. The method of knitting a therapeutic and support garment as claimed in claim 11, knitting a non-elastomeric stretchable yarn in the toe portion of said foot portion forming a sheer stretchable band and closing said foot portion with a seam to form a relatively freely stretchable toe portion.

13. The method of knitting a therapeutic and support garment as claimed in claim 11, knitting a heel-instep circumferential band integrally with said boot and foot portions with substantially less tension to increase the stitch length in said band to apply less retractive force on the heel, ankle and instep of the garment in the heel-instep on the foot of a wearer.

* * * * *